US008893313B2

(12) United States Patent
Lowther

(10) Patent No.: US 8,893,313 B2
(45) Date of Patent: Nov. 25, 2014

(54) REMOVABLE REFLECTIVE HARD HAT BRIM GUARD

(71) Applicant: Brimguard LLC, St. Petersburg, FL (US)

(72) Inventor: Robert D. Lowther, St. Petersburg, FL (US)

(73) Assignee: Brimguard LLC, St. Petersburg, FL (US)

( * ) Notice: Subject to any disclaimer, the term of this patent is extended or adjusted under 35 U.S.C. 154(b) by 0 days.

(21) Appl. No.: 13/694,867

(22) Filed: Jan. 14, 2013

(65) Prior Publication Data

US 2013/0180035 A1 Jul. 18, 2013

Related U.S. Application Data

(60) Provisional application No. 61/631,884, filed on Jan. 13, 2012.

(51) Int. Cl.

| | |
|---|---|
| ***A42B 3/00*** | (2006.01) |
| ***A42B 1/24*** | (2006.01) |
| ***A42B 3/06*** | (2006.01) |
| ***A42B 3/04*** | (2006.01) |

(52) U.S. Cl.

CPC . *A42B 1/24* (2013.01); *A42B 3/062* (2013.01); *A42B 3/0406* (2013.01)

USPC ..... 2/422

(58) Field of Classification Search

USPC ..... 2/2, 5, 16, 22, 422, 425, 175.6

See application file for complete search history.

(56) References Cited

U.S. PATENT DOCUMENTS

| | | | | | |
|---|---|---|---|---|---|
| 128,780 | A | * | 7/1872 | Battle | 2/10 |
| 1,179,631 | A | * | 4/1916 | Hurd | 2/171.02 |
| 1,587,681 | A | * | 6/1926 | Schumacher | 2/175.6 |
| 2,177,145 | A | * | 10/1939 | Lewis | 2/416 |
| D136,471 | S | * | 10/1943 | Wulsin | D2/893 |
| 2,728,913 | A | * | 1/1956 | Connor | 2/10 |
| 3,582,990 | A | * | 6/1971 | Frieder | 2/6.6 |
| 4,316,289 | A | * | 2/1982 | Hild | 2/10 |
| 4,517,685 | A | * | 5/1985 | Lesley | 359/518 |
| 4,547,908 | A | * | 10/1985 | Karlsson et al. | 2/424 |
| 5,088,126 | A | * | 2/1992 | Mathis | 2/181 |
| 5,544,027 | A | | 8/1996 | Orsano | |
| D379,679 | S | * | 6/1997 | Poole | D29/122 |
| 5,727,250 | A | * | 3/1998 | Black | 2/10 |
| 5,810,467 | A | | 9/1998 | Hurwitz | |
| 5,862,520 | A | * | 1/1999 | Wyant | 2/10 |
| 6,061,836 | A | * | 5/2000 | Peters | 2/175.6 |
| 6,182,295 | B1 | * | 2/2001 | Sciglia | 2/200.1 |
| 6,237,155 | B1 | | 5/2001 | Seegar | |
| 6,260,204 | B1 | * | 7/2001 | Morrissey | 2/172 |
| 6,374,423 | B1 | * | 4/2002 | Anderson et al. | 2/425 |
| 6,497,493 | B1 | | 12/2002 | Theisen | |

* cited by examiner

*Primary Examiner* — Richale Quinn

(74) *Attorney, Agent, or Firm* — John S. Hale; Gipple & Hale

(57) ABSTRACT

A protective brim guard for a hard hat is provided which has an enclosed elastic band with an outer bead section and a skirt extending inward from the bead section. The bead section has a circular configuration forming an internal chamber which communicates with the outside atmosphere via a channel leading to the chamber. The internal chamber and channel allows the bead section to be expanded and contracted for mounting over a hard hat brim. The skirt defines an interior planar surface which is adapted to engage the exterior surface of a hard hat when the brim guard is mounted to the hard hat.

12 Claims, 3 Drawing Sheets

REMOVABLE REFLECTIVE HARD HAT BRIM GUARD

RELATED APPLICATION

This is a utility application claiming benefit and priority from U.S. Provisional Application No. 61/631,884 filed Jan. 13, 2012.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention generally relates to protective wearable devices which reflect light rays and more particularly, is concerned with a hard hat with a removable reflective brim guard which also protects the hard hat.

2. Background of the Invention

The present invention is generally directed toward activities, such as working and walking, undertaken at dusk, nighttime or in a darkened area or in an area with limited visibility where individuals must comply with mandated safety regulations including the wearing of hard hats in order to avoid on job injury.

With the increasing numbers of persons who engage in construction, manufacturing, mining, drilling or other outdoor activities that are required to wear protective head gear such as hard hats, attempts have been made to provide head gear and clothing which will provide a degree of visibility and flexibility. For example, as shown in U.S. Pat. No. 4,517,685 issued May 21, 1985, light reflective material has been used in the prior art in the nature of thin cloth bands variously attached at the wrist, ankle and head portions of the wearer.

In the prior art, various methods for constructing reflective hard hats or safety helmets are disclosed. For example, U.S. Pat. No. 5,810,467 issued Sep. 22, 1998 describes an illuminated protective hard hat that includes an electroluminescent lamp that is secured to the outside of an outer shell of the hard hat. U.S. Pat. No. 5,544,027 issued Aug. 6, 1996 describes a safety helmet to which a string of LEDs are affixed, using an adhesive, to an outer shell of the safety helmet. U.S. Pat. No. 6,497,493 issued Dec. 24, 2002 describes a hard hat having a mounting bracket for supporting a battery-powered light on an exterior portion of an outer shell of the hard hat. U.S. Design Pat. No. D379,679 issued Jun. 3, 1997 illustrates a brim for a hard hat while U.S. Pat. No. 4,316,289 issued Feb. 23, 1982 discloses a sun screen for a hard hat.

Of related interest, U.S. Pat. No. 6,237,155 issued May 29, 2001 describes a ball hat with front and rear light reflective strips.

However, none of the aforementioned patents disclose a removable hard hat brim band which protects the edge of the hard hat and thus, the wearer of same and provides a removable reflective brim guard band illuminating the hard hat and therefore the hard hat wearer.

SUMMARY OF THE INVENTION

The present invention provides a removable protective light reflective brim elastic guard for a hard hat that is designed to satisfy the aforementioned needs. The brim guard band of the present invention, preferably used on a hard hat, includes a light reflective outer bead portion which is removably mounted on the hard hat brim and an integral skirt section which extends upward and inward toward the crown of the hard hat and engages the surface of the hard hat to provide a safety reflective strip and protective guard for the hat wearer.

It is an object of the present invention to provide a removable brim guard which provides protection from damage to the brim of a hard hat by absorbing impact to the brim of the hard hat.

It is another object of the invention to provide an improved griping area for a hard hat by increasing the grip area around the edge of a hard hat.

It is a further object of the present invention to provide a brim guard for a hard hat to create an area for light reflection on a hard hat which is removable and does not degrade the surface area of the hard hat.

An even further object of the present invention is to provide a brim guard band which provides improved deflection of rain or other liquids away from the face of the wearer.

It is still another object of the present invention to provide a removable reflective hard hat brim guard which is susceptible of a low cost of manufacture with regard to both materials and labor, and which accordingly is then susceptible of low prices of sale to the consuming public, thereby making same economically available to the buying public.

It is yet another object of the invention to provide a brim guard which can be used with existing hard hats and is adaptable for use on hard hats produced by different manufacturers.

These and other objects, advantages, and novel features of the present invention will become apparent when considered with the teachings contained in the detailed disclosure which along with the accompanying drawings constitute a part of this specification and illustrate embodiments of the invention which together with the description serve to explain the principles of the invention.

Figure 1:
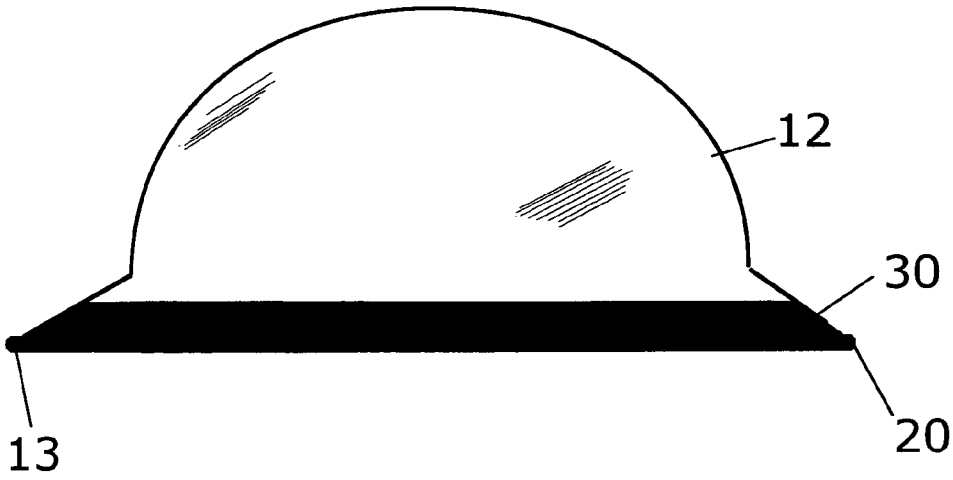
FIG. 1 is a side elevation view of the inventive brim guard band mounted on a hard hat.

These and other objects, advantages, and novel features of the present invention will become apparent when considered with the teachings contained in the detailed disclosure along with the accompanying drawings.

DETAILED DESCRIPTION OF THE INVENTION

The preferred embodiment and best mode of the present invention is shown in FIGS. 1 through 6.

The present invention is a removable elastic brim guard band 10 made of silicone, nitrile, butyl rubber or any other elastic material which is mounted to the brim 13 of a hard hat 12. The brim guard band 10 is preferably of an oval one piece construction but the geometry can be varied to accommodate other hard hat configurations. The brim guard 10 is mounted to the hard hat without the use of adhesive or glues. The use of adhesive or glues could impact the integrity of the hard hat shell. The brim guard has a non-stick surface which prevents application of appliqués or stickers which may be metallic and cause the hard hat to be conductive, thus posing a potential electrical shock hazard. The brim guard band 10 has a bead section 20 defining a circular configuration which is mounted on the hard hat brim or lip 13. The bead section 20, which preferably has a rounded outer surface, defines an internal rounded chamber or cavity 22 with a throughgoing channel 24 providing a clear path from the internal cavity 22 to the outside atmosphere. This configuration allows the lower lip 26 of the bead section 20 to be placed against the under surface of the edge of brim 13. The bead section lip 26 has a rounded end 27 which engages the lower surface of the hard hat brim and outer edge of the hard hat brim is inserted through channel 24 into chamber 22. It should be noted that the bead section has a greater thickness than that of its associated skirt so that it will absorb the hats mounting stresses on the material to prevent ripping and tearing of the bead section as it is mounted or removed from the hard hat brim.

Figure 2:
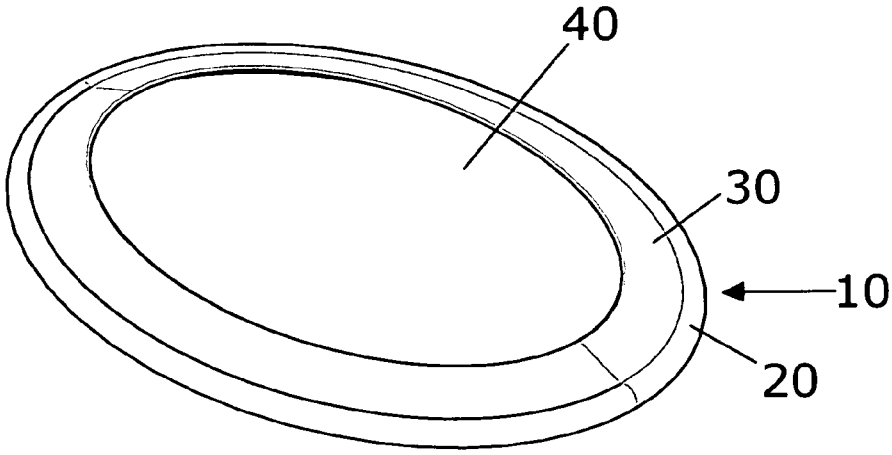
FIG. 2 is a perspective view of the inventive brim guard band.
Figure 3:
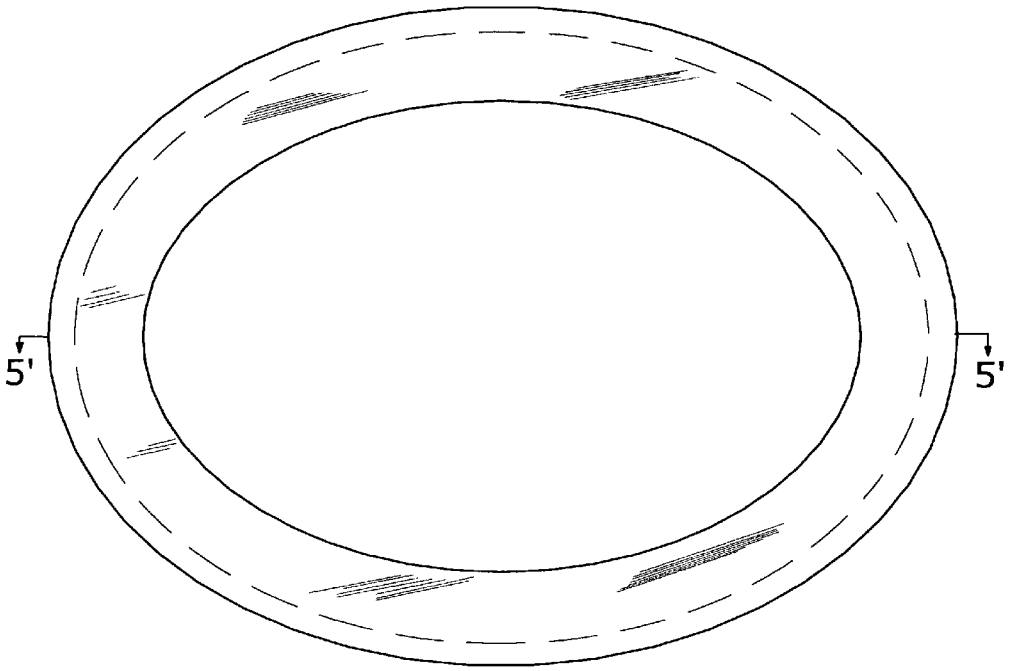
FIG. 3 is an enlarged top plan view of the brim guard band of FIG. 2.
Figure 4:
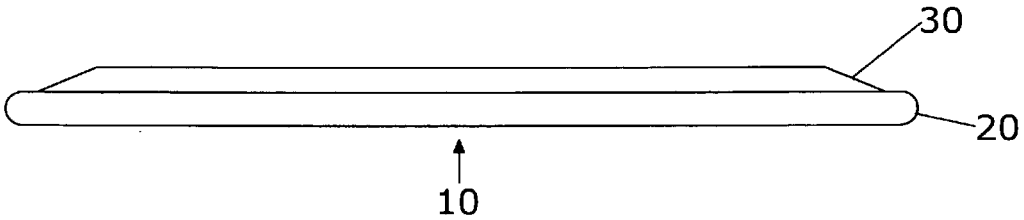
FIG. 4 is a side elevation view of the brim guard band shown in FIG. 3.
Figure 5:
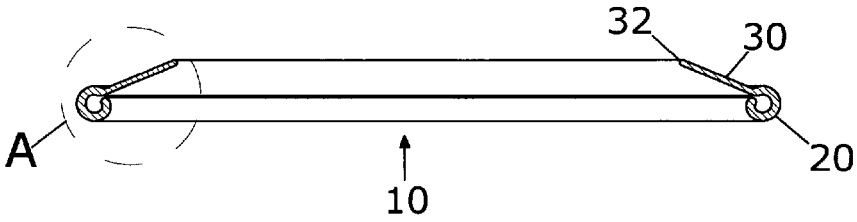
FIG. 5 is a cross section view of FIG. 3 taken along line 5'-5'.
Figure 6:
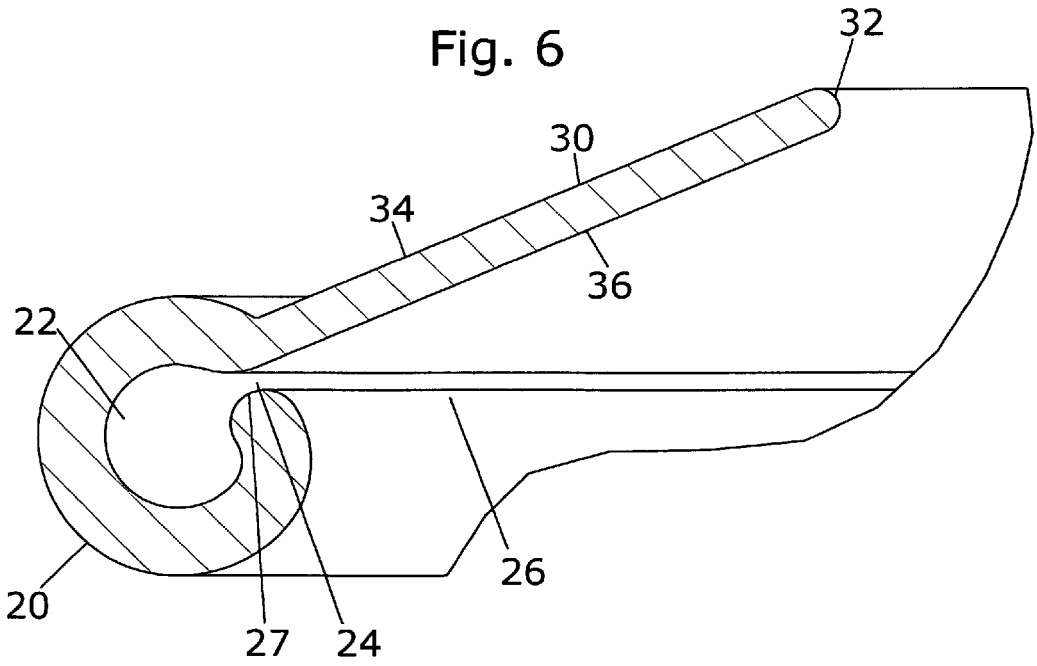
FIG. 6 is an enlarged partial cross section view taken from circle A of FIG. 5.

An integral skirt 30 extends upward from the bead section 20 at an angle to a plane taken across the bottom of end 27 and inward from the upper opposed lip of the bead section 20 around the hard hat 12 as shown in FIG. 1 to form a truncated cone. The skirt 30 has a rounded distal end 32 and defines a circular (or oval) opening 40 as shown in FIG. 2 which fits over the hard hat and around upper surface of the brim or the side surface of the hard hat. The top surface 34 and bottom surface 36 of the skirt are preferably planar providing a smooth surface area. Both the bead section 20 and the skirt 30 are preferably molded as an integral one piece construction and are preferably constructed of an elastic material which is coated with a light reflective coating or includes a light reflective material so that it will be reflective of light. The skirt 30 provides an enlarged area of light reflectivity by application of the light reflective coating or use of a reflective compound included in the material and may also be used to allow the attachment of a plastic case using a clip fastener. The case can contain safety equipment such as earplugs. The skirt 30 and the bead section 20 when mounted to the hard hat provide for deflection of excess water or other liquid which may accumulate on top of the brim of a hard hat. In addition to the reflective nature of the band, the band provides protection from damage to the hard hat brim from impact by absorbing the impact. The invention also provides improved gripping of the hard hat by providing an elastic area which is easily gripped by the wearer's hand. Thus, the band 10 forms a removable cover for the brim 13 of the hard hat 12. Since the band 10 is removable, it does not affect the surface of the hard hat and can be easily replaced or changed. As previously noted, the band 10 is preferably oval so that it easily sets over a conventional hard hat but can be formed in any complimentary geometric configuration The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What I claim is:

1. A protective brim guard for a hard hat comprising;

(a) an endless elastomeric band, said band having an outer bead section with a substantially circular cross section and an integral skirt extending inward from said outer bead section, said bead section having a circular external configuration defining a pre-formed internal chamber, said chamber communicating with the outside atmosphere via a channel leading to said chamber, said chamber and channel allowing said bead section to be expanded and mounted to and around a brim of a hard hat;

(b) said skirt defining an interior planar surface which is adapted to engage an exterior surface of a hard hat when said band is mounted to said brim of said hard hat (c) said bead section and said skirt being both integrally molded from the same material, said bead section being formed with a circular wall defining said internal chamber and being thicker than said skirt.

2. A protective brim guard for a hard hat as claimed in claim 1 wherein said band is coated with a light reflective material.

3. A protective brim guard for a hard hat as claimed in claim 1 wherein said band is made of a material which is fire resistant.

4. A protective brim guard for a hard hat as claimed in claim 1 wherein said band is constructed of a material taken from a group consisting of silicone, nitrile, and butyl rubber.

5. A protective brim guard for a hard hat as claimed in claim 1 wherein said band is made of light reflective material.

6. A protective brim guard for a hard hat as claimed in claim 1 wherein said band is provided with a decorative design.

7. A removable brim guard for a hard hat as claimed in claim 1 wherein said skirt is angled from a plane taken across a bottom of said bead section.

8. A removable brim guard for a hard hat defining a brim comprising;

(a) an oval shaped reflective band formed from an elastic material, said band having a closed bead section with a rounded exterior surface and defining an interior bead chamber having a circular cross section, said bead section further defining a pre-formed channel of uniform width extending around said bead section providing communication of said interior bead chamber with the atmosphere allowing said bead section to be mounted to the brim of a hard hat and enclose the entire brim of said hard hat and an integral closed skirt member extending angularly away from said closed bead section with a distal end being positioned inward of a portion of said skirt member integral with said bead section to form a truncated conical configuration adapted to extend over said hard hat (b) said skirt member defining an interior planar surface which extends inwardly from said bead section and is adapted to engage an exterior surface of a hard hat when said elastic band is mounted around said hard hat brim and an exterior planar surface, said skirt forming a truncated conical configuration; and (c) said bead section being of a greater thickness than said skirt.

9. A removable brim guard for a hard hat as claimed in claim 8 wherein said band is coated with a light reflective material.

10. A removable brim guard for a hard hat as claimed in claim 8 wherein said band is made of a material which is fire resistant.

11. A removable brim guard for a hard hat as claimed in claim 8 wherein said band is constructed of a material taken from a group consisting of silicone, nitrile, and butyl rubber.

12. A removable brim guard for a hard hat as claimed in claim 8 wherein a distal end of said skirt is rounded.

* * * * *